US006823806B1

(12) United States Patent
Buono

(10) Patent No.: US 6,823,806 B1
(45) Date of Patent: Nov. 30, 2004

(54) COLLAPSIBLE TABLE

(75) Inventor: Steven A. Buono, Greeneville, TN (US)

(73) Assignee: Maxchief Investments Limited, Kaohsiung (TW)

( * ) Notice: Subject to any disclaimer, the term of this patent is extended or adjusted under 35 U.S.C. 154(b) by 124 days.

(21) Appl. No.: 10/272,117

(22) Filed: Oct. 16, 2002

Related U.S. Application Data

(63) Continuation-in-part of application No. 10/021,140, filed on Dec. 12, 2001, now Pat. No. 6,622,644.

(51) Int. Cl.[7] ..... A47B 3/00
(52) U.S. Cl. ..... 108/132
(58) Field of Search ..... 108/131, 132, 108/129, 130, 115; 248/188, 188.1, 188.6

(56) References Cited

U.S. PATENT DOCUMENTS

| | | | | |
|---|---|---|---|---|
| 159,227 A | | 1/1875 | Sinclair | |
| 236,197 A | | 1/1881 | Valley | |
| 1,312,137 A | * | 8/1919 | Schloss | 108/131 |
| 1,487,497 A | | 3/1924 | Whewell | |
| 1,757,260 A | | 5/1930 | Silverman | |
| 1,956,946 A | | 5/1934 | Duffy | |
| 2,278,810 A | | 4/1942 | Virtue et al. | |
| 2,474,450 A | | 6/1949 | Woodruff | |
| 2,939,516 A | | 6/1960 | Drew | |
| 3,072,451 A | | 1/1963 | Greenberg et al. | |
| 3,357,729 A | | 12/1967 | Krueger | |
| 3,777,675 A | | 12/1973 | Hanusiak | |
| 4,658,735 A | | 4/1987 | Holton | |
| 4,951,576 A | | 8/1990 | Cobos et al. | |
| D350,862 S | | 9/1994 | Beller | |
| 5,865,128 A | | 2/1999 | Tarnay | |
| D414,626 S | | 10/1999 | Collins et al. | |
| 5,983,807 A | * | 11/1999 | Tarnay et al. | 108/132 |
| 5,984,047 A | | 11/1999 | Rogers | |
| D419,332 S | | 1/2000 | Collins et al. | |
| 6,112,674 A | | 9/2000 | Stanford | |
| 6,374,756 B1 | * | 4/2002 | Fieldwick et al. | 108/131 |
| 6,431,092 B1 | | 8/2002 | Stanford | |
| 6,561,106 B2 | * | 5/2003 | Tseng | 108/131 |
| 6,615,743 B2 | * | 9/2003 | Nien | 108/132 |
| 6,622,644 B2 | * | 9/2003 | Buono | 108/132 |
| 6,655,301 B2 | * | 12/2003 | Stanford | 108/132 |
| 6,694,897 B2 | * | 2/2004 | Lou-Hao | 108/132 |

FOREIGN PATENT DOCUMENTS

| | | | |
|---|---|---|---|
| FR | 2557934 | * | 7/1985 |
| GB | 2214796 | * | 9/1989 |

* cited by examiner

*Primary Examiner*—Jose V. Chen
(74) *Attorney, Agent, or Firm*—Luedeka, Neely & Graham, P.C.

(57) ABSTRACT

A collapsible table includes an elongate table top having a substantially planar top surface and a bottom surface opposite the top surface. The bottom surface includes opposing elongate first and second side edges, an elongate first channel which is substantially parallel to the elongate first side edge, and an elongate second channel which is substantially parallel to the elongate second side edge. Projections, which are preferably integrally molded into the bottom surface, are disposed on opposing sides of each of the elongate first and second channels. A support frame is attached to the bottom surface of the table top which includes a first elongate tubular support member disposed in the elongate first channel, and a second elongate tubular support member disposed in the elongate second channel. The support frame also includes first and second pivotal leg assemblies, each having a tubular cross member pivotally attached between the first and second elongate tubular support members, and leg sections attached to the tubular cross members. The first and second projections in the bottom surface of the table top provide a snap fit to retain the first and second elongate tubular support members within the elongate first and second channels.

22 Claims, 7 Drawing Sheets

(section I-I)

(Section I-I)

COLLAPSIBLE TABLE

This application is a continuation-in part of application Ser. No. 10/021,140, filed Dec. 12, 2001, now U.S. Pat. No. 6,622,644.

FIELD

This invention relates to collapsible furniture. More particularly, the invention relates to a lightweight table having a blow-molded table top containing improved assembly and support features.

BACKGROUND

Collapsible or foldable tables are widely used in a number of applications, such as to provide temporary table space in multipurpose meeting rooms like banquet halls and hotel conference rooms. Collapsible tables are popular for such applications because they may be folded into a relatively flat package which provides for ease of storage between uses.

Prior collapsible table designs have been lacking in numerous respects. Some tables, such as those having table tops made of solid wood or particle board, are extremely heavy and unwieldy, causing difficulty in transport and setup. Such heavy tables can also cause severe damage or injury if dropped or mishandled during transport and/or use, as when they are set up and taken down. Lighter-weight table designs having a hollow core are easier to handle, but are not without challenges with regard to support and assembly. Tables having adequate support for the top surface are generally more complicated to assemble. Tables that are easier to assemble do not always provide suitable support for the table top and top surface.

What is needed, therefore, is a folding table which is sturdy, relatively light-weight, relatively easy to assemble, and has a relatively rigid and well-supported top surface.

SUMMARY

The above and other needs are provided by a collapsible table having an elongate table top that includes a substantially planar top surface, and a bottom surface opposite the top surface. The bottom surface of the table top has opposing elongate first and second side edges and opposing end edges that are substantially perpendicular to the first and second side edges. The bottom surface also includes elongate first and second cylindrical channels that are adjacent and substantially parallel to the elongate first and second side edges. The elongate first and second cylindrical channels have first and second inside radii, respectively. Attached to the bottom surface of the table top is a support frame that includes first and second elongate cylindrical support members received within the elongate first and second cylindrical channels, respectively. The first and second elongate cylindrical support members have first and second outside radii that are equivalent to or slightly smaller than the first and second inside radii of the elongate first and second cylindrical channels. The support frame also has first and second pivotal leg assemblies, each having a cross member pivotally attached to and spanning a space between the first and second elongate cylindrical support members. The leg assemblies each include one or more leg sections attached to the cross member.

In one embodiment, the bottom surface of the collapsible table includes projections disposed on opposing sides of each of the elongate first and second channels. The first and second projections, which are preferably integrally molded into the bottom surface, provide a snap fit to retain the first and second elongate support members within the elongate first and second channels.

One advantage of the invention is that it provides a table that it is more robust and easier to assemble than conventional tables. Another advantage of a table made according to the invention is that the elongate first and second channels and the first and second projections enable repeatable capture of the support members on the bottom surface of the table top, so that assembly of the table may be completed with less variation in quality from table to table.

BRIEF DESCRIPTION OF THE DRAWINGS

The above and other advantages of the invention will become apparent by reference to the following detailed description when considered in conjunction with the accompanying figures of an exemplary embodiment of the invention, wherein like reference numbers indicate like elements throughout the several views, and wherein.

DETAILED DESCRIPTION

Figure 1:
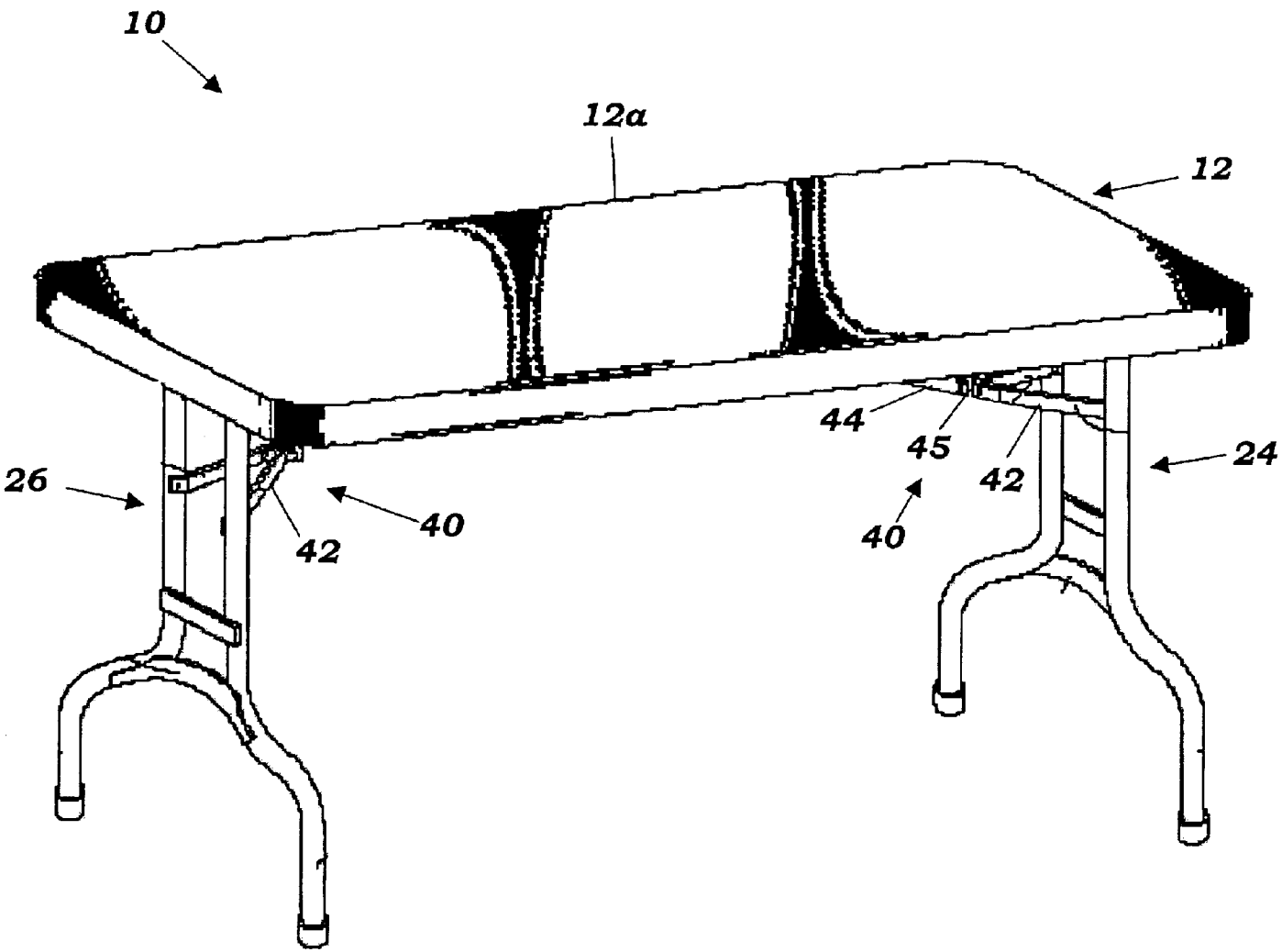
FIG. 1 is a top perspective view of a collapsible table illustrating features of a preferred embodiment of the invention.
Figure 2:
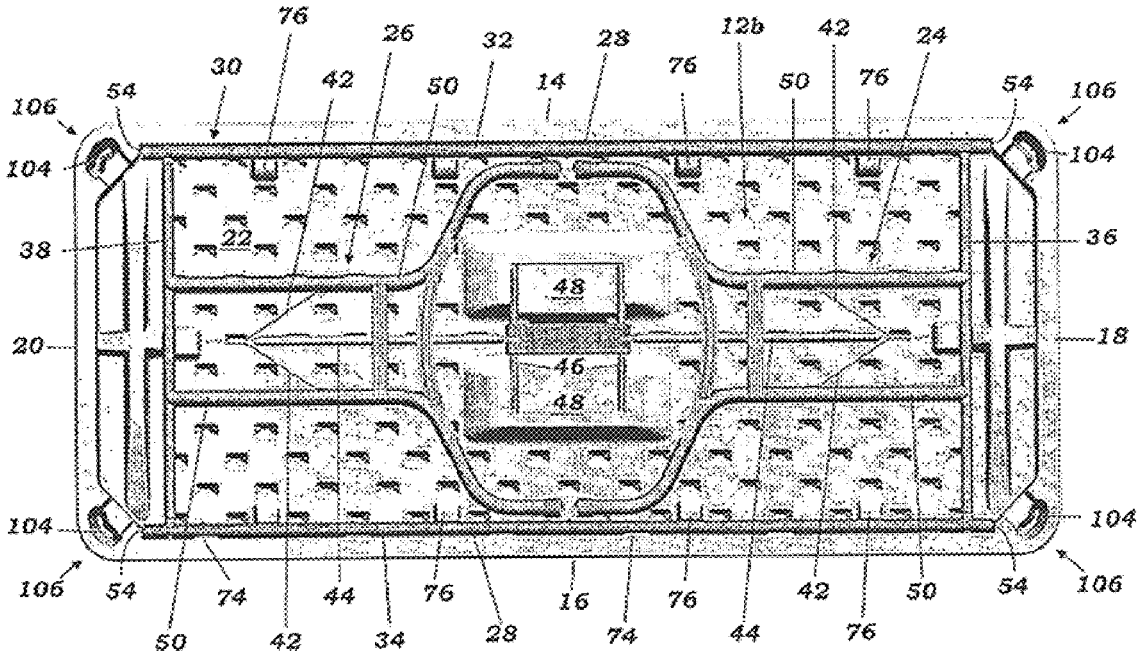
FIG. 2 is a bottom plan view of an assembled collapsible table illustrating features of a preferred embodiment of the invention.

Referring now to FIGS. 1–4, there is generally depicted a collapsible table 10 according to the invention. The table 10 includes a table top section 12 having a substantially planar top surface 12*a* and an opposing bottom surface 12*b* (FIG. 2). In the preferred embodiment, the table top 12 is formed from a thermoplastic material, such as polyethylene, by a molding process, such as blow molding. It is preferred that the table top 12 be substantially hollow, thereby decreasing the weight of the table 10. Such a lightweight table top 12 is well suited for applications where ease of handling and transport are important. Although thermoplastic is the preferred material for the table top 12, one skilled in the art will appreciate that the table top 12 could be formed of other materials, such as fiberglass or other composite materials, wood, or metal. Thus, the scope of the invention is not limited to any particular material or forming method for the table top 12.

In a preferred embodiment, the table 10 has a substantially rectangular, elongate shape. It should be appreciated, however, that important features of the invention may be applied to tables having table tops that are square, circular, elliptical, or any other shape. Thus, the scope of the invention is not limited to any particular shape of the table top 12.

As shown in FIG. 1, collapsible leg assemblies 24 and 26 are attached to the bottom of the table top 12. The leg assemblies 24 and 26, and their mounting structure for attachment and rotation with respect to the top 12, are described in more detail hereinafter.

Figure 3:
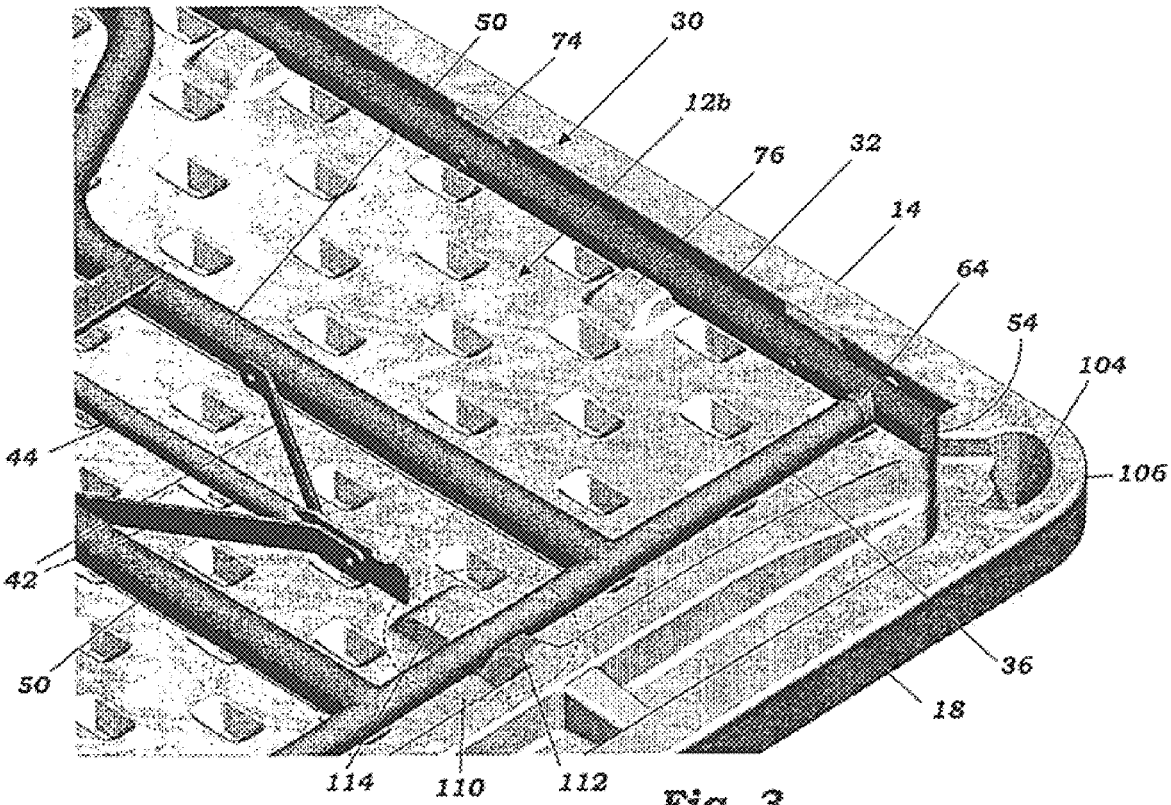
FIGS. 3 and 4 are perspective views of portions of a bottom surface of a collapsible table illustrating features of a preferred embodiment of the invention.

As depicted in FIGS. 2 and 3, the bottom surface 12*b* of the table top 12 includes elongate opposing first and second side edges 14 and 16, and opposing elongate end edges 18 and 20. As shown in FIG. 3, a main portion 22 of the bottom surface 12*b* is recessed with respect to the side and end edges. When the table 10 is in a storage configuration, the main portion 22 provides storage of the leg assemblies 24 and 26 generally between a plane defined by the side edges 14 and 16 and end edges 18 and 20 and the main part of the interior of the bottom surface 12*b* of the table top 12. As described in more detail below, important features of the invention are provided in the main portion 22 of the bottom surface 12*b* of the table 10.

Figure 4:
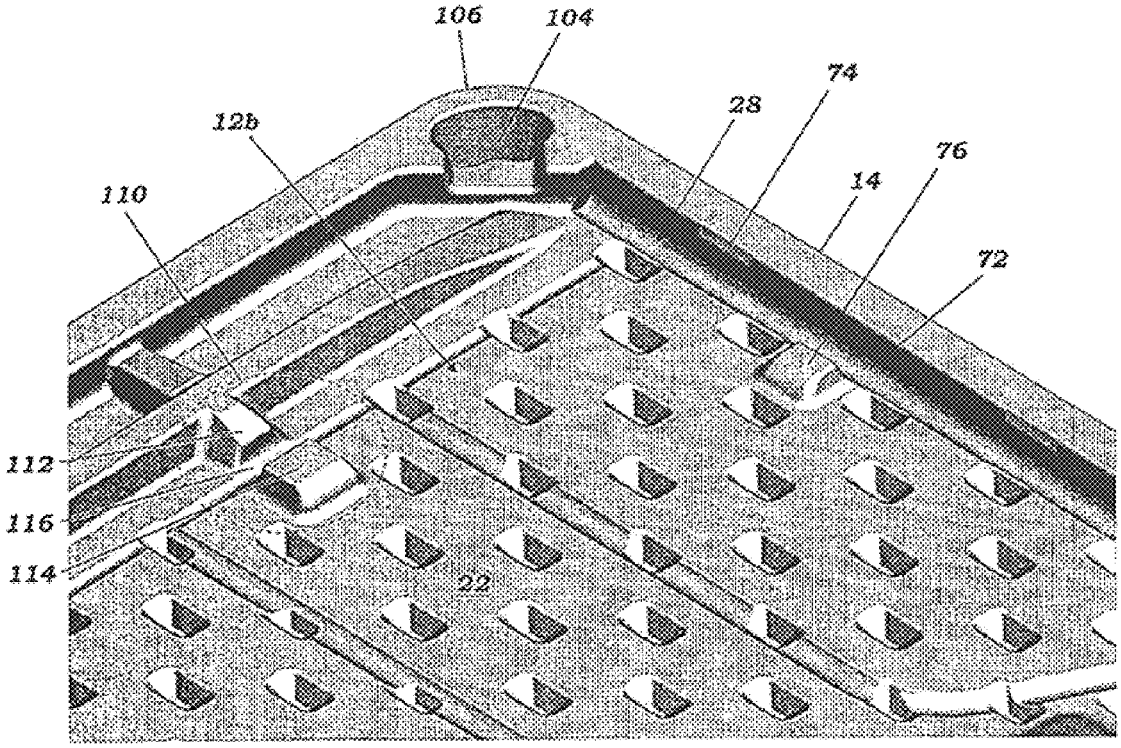

FIG. 4 depicts a portion of the bottom surface 12*b* with other of the table components removed to more clearly show features of the bottom surface 12*b*. As shown in FIG. 4, an elongate first channel 28 is provided in the main portion 22 of the bottom surface 12*b* adjacent the side edge 14. A similar elongate second channel 28 is provided in the main portion 22 adjacent the opposite side edge 16, and running substantially parallel to the first channel 28. Referring again to FIGS. 2 and 3, a support frame 30, including first and second elongate tubular members 32 and 34 and elongate tubular cross members 36 and 38, is provided as part of the structure that supports the table top section 12 in spaced relation above a floor or other support surface. Leg assemblies 24 and 26, forming an additional part of this structure, are attached to the cross members 36 and 38 respectively. The cross members 36 and 38 are preferably rotatively received in and supported on the first and second elongate tubular members 32 and 34 to enable folding of the leg assemblies 24 and 26 with respect to the bottom surface 12*b*.

In order to maintain the leg assemblies 24 and 26 in their unfolded or fully deployed position as shown in FIG. 1, brace assemblies 40 are preferably provided. Each of the brace assemblies 40 includes a pair of brace members 42, a center support rod 44, and a locking collar 45. Each brace assembly 40 also includes a pivot bar 46 preferably disposed in a molded projection 48 located substantially in the center of the main portion 22 for pivotal movement of the center support rods 44 thereabout. Further details of a preferred embodiment of the brace assemblies 40 can be found in co-pending application Ser. No. 10/021,140, the disclosure of which is incorporated herein by reference as if fully set forth. It will be recognized that other constructions of the brace assemblies 40 may be provided without departing from the invention as set forth herein. The brace assemblies 40 are attached to leg portions 50 of leg assemblies 24 and 26. The leg portions 50 are, in turn, attached to the tubular cross-members 36 and 38 for rotation therewith.

Although leg portions 50 and their associated cross members 36 and 38 are preferably joined together to move together as a unit with respect to the tubular members 32 and 34, it is also within the scope of the invention that cross members 36 and 38 may be fixedly or non-rotatably connected to the tubular members 32 and 34, and that the leg portions 50 then pivot upon the cross members 36 and 38, or upon individual pivot blocks, thereby entirely eliminating the need for cross members 36 and 38.

Figure 5:
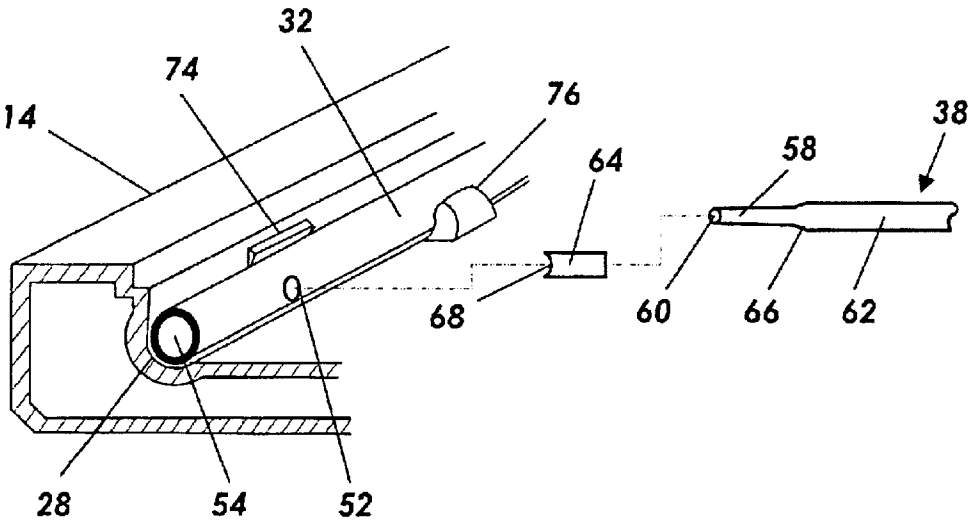
FIG. 5 is a cross-sectional perspective view of a portion of a collapsible table illustrating features of a preferred embodiment of the invention.

With reference now to FIGS. 3 and 5, further features of the support frame 30 will now be described. As set forth above, the leg assemblies 24 and 26 are preferably attached to the first and second elongate tubular support members 32 and 34 by means of the pivoting tubular cross members 36 and 38. Each of the leg assemblies 24 and 26, cross members 36 and 38, and support members 32 and 34 may be constructed of a wide variety of materials, including, but not limited to, metal, wood, plastic, and the like. A preferred material for the support members 32 and 34, leg assemblies 24 and 26, and cross members 36 and 38 is metal that is painted or coated as desired for durability and aesthetics.

As shown in FIG. 5, the first and second elongate tubular support members 32 and 34 contain substantially circular apertures 52 adjacent the ends 54 thereof. The apertures 52 are specially designed to pivotally receive the distal or end portions 58 of the tubular cross members 36 and 38. In that regard, the apertures 52 may extend entirely through the support members 32 and 34. However, the invention is not limited to apertures extending completely through both sides of the support members 32 and 34.

It is preferred that central portions 62 of the cross members 36 and 38 have a slightly larger outer diameter than that of the distal portions 58, the latter of which are dimensioned to slidably receive thereon collars or bushings 64. The bushings 64 preferably each have an inside diameter that may be the same as or slightly greater than the outer diameter of the distal portions 58 and less than the outer diameter of the central portion 62. The distal portions 58 of the cross members 36 and 38 are therefore received within the bushings 64, as depicted in FIGS. 3, 5, and 6*a–b*. As shown in FIGS. 3, 5, and 6*a–b*, the bushings 64 also act as spacers between shoulder portions 66 of the cross members 36 and 38 and the tubular support members 32 and 34 to maintain the position of cross members 36 and 38 between the tubular members 32 and 34. As shown in FIG. 5, one end 68 of the collars 64 is preferably curved to conform substantially to the shape of the outer surface of the tubular support members 32 and 34. Alternatively, the bushings 64 may be substantially cylindrical, not having a curved or shaped end 68, and not extending into the apertures 52. In any case, the bushings 64 maintain the cross members 36 and 38 in a substantially fixed lateral position relative to the first and second support members 32 and 34 as the leg assemblies 24 and 26 are folded and unfolded, thereby preventing back-and-forth rattling of the cross members 36 and 38.

Figure 6A:
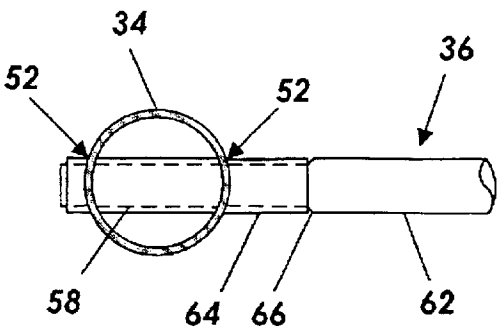
FIGS. 6*a–b* are cross-section views of a portion of a support channel and cross member for a collapsible table illustrating features of preferred embodiments of the invention.

In an alternative embodiment, as depicted in FIG. 6*a* (cross-section I—I in FIG. 2), the bushings 64 may be configured with uniform inner and outer diameters to be inserted fully through the apertures 52 in the tubular support members 32 and 34.

Figure 6B:
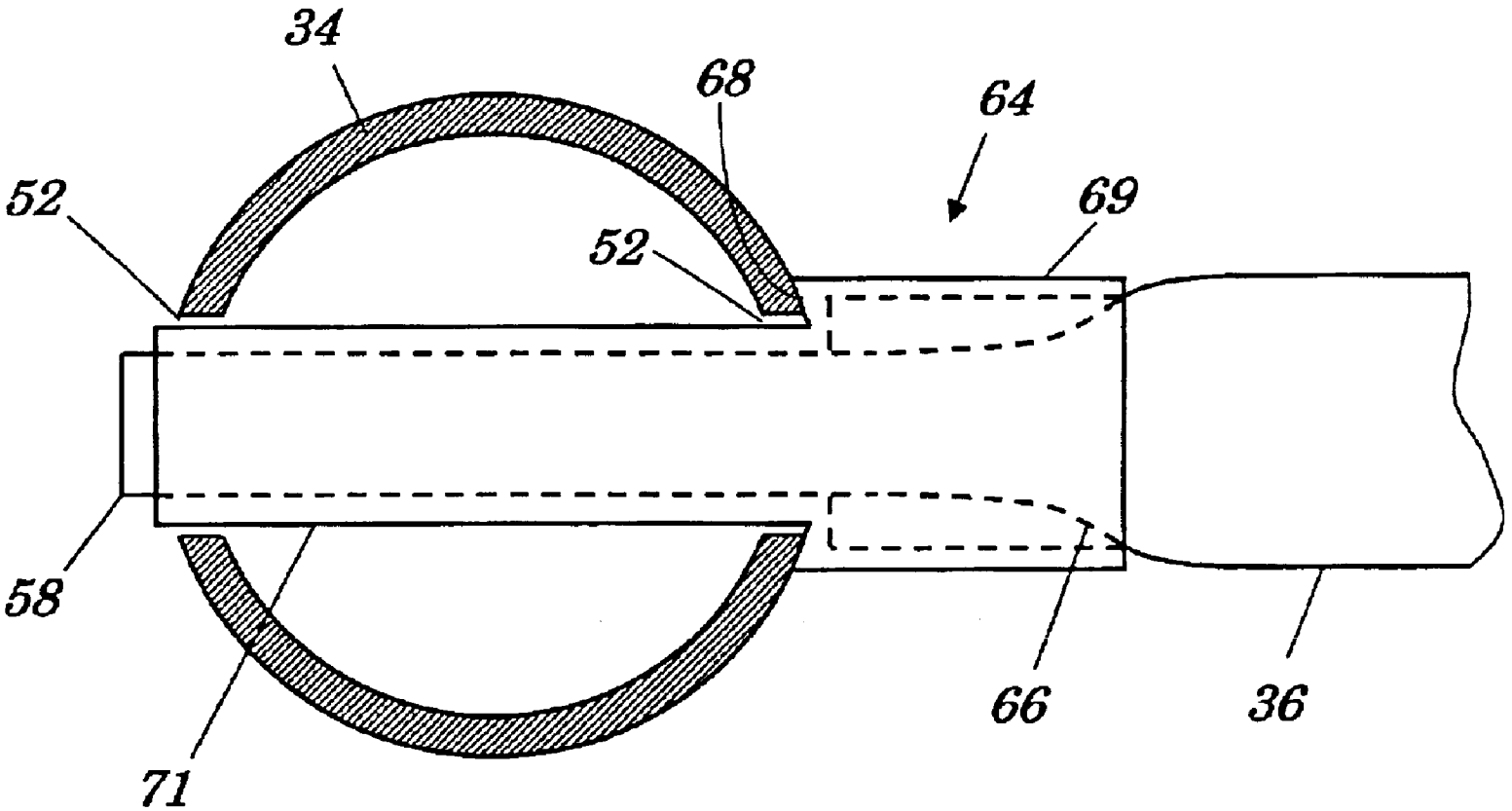

In a further alternative embodiment shown in FIG. 6*b*, the bushings 64 may include a larger-diameter cylindrical part 69 having a shaped end 68 that conforms generally to the surrounding outer surface of tubes 32 and 34. The shaped end 68, which preferably abuts against the tubes 32 and 34, transitions to a reduced-diameter cylindrical part 71 that is pivotally received through the apertures 52. The reduced-diameter distal ends 58 of the cross members 36 and 38 therefore extend through and at least partially into the parts 71 that are received in the apertures 52. Thus, in the embodiment of FIG. 6*b*, the bushings 64 act as both spacers to maintain the lateral position of the cross-members 36 and 38, and as reduced-friction supports for the ends 58 of the cross members 36 and 38 within the apertures 52.

In all embodiments of the bushings 64, they are preferably made of a resilient, substantially low friction material, including but not limited to molded or extruded friction-reducing plastic materials, such as fluoropolymeric materials and ultra high density polyolefinic materials, or relatively soft metals such as brass and aluminum.

As shown in FIG. 4, the channels 28 in the bottom surface 12*b* of the top 12 preferably have elongate cylindrical inside surfaces 72, the inside radius of which is preferably equivalent to, or slightly larger than, the outside radius of the cylindrical support members 32 and 34. The cylindrical inside surface 72 provides a location feature for precisely locating the support members 32 and 34 relative to the edge 14 and main portion 22 of the bottom surface 12*b* during assembly of the table 10. Thus, the cylindrical inside surface 72 of the channels 28 facilitates the table assembly process by capturing the circular support members 32 and 34 in precise alignment and position with respect to each other and to the top 12.

Figure 7:
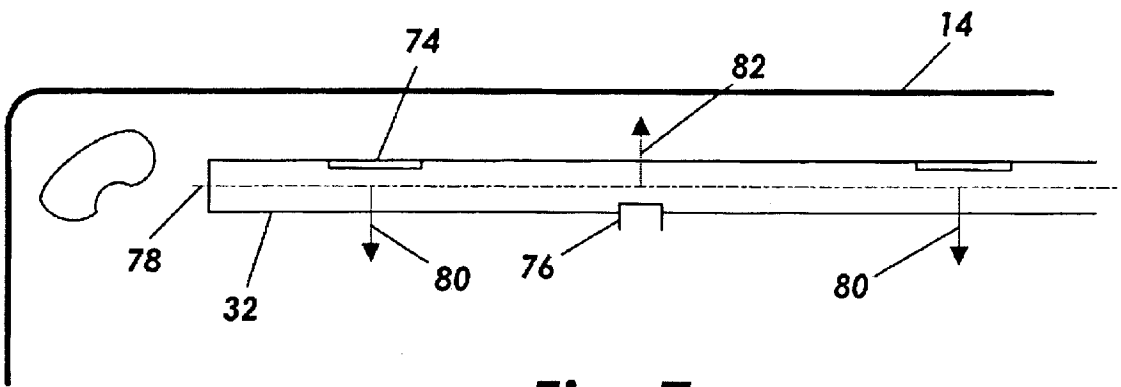
FIG. 7 is a plan view of a portion of the bottom surface of a table illustrating features of a preferred embodiment of the invention.

Other important features of the invention include bosses 74 and 76 which slightly extend over the channels 28 at longitudinally-staggered spaced-apart locations along the lengths of the channels 28 on opposing sides thereof. The bosses 74 and 76, which are preferably molded into the bottom surface 12*b* of the table 12, provide a further mechanism for precisely and securely locating the support members 32 and 34 relative to the main portion 22 and edges 14 of the bottom surface 12*b*. The bosses 74 and 76 also provide substantially reproducible assembly tolerances for the table top section 12 with respect to the support frame 30. Variations in the distance of the support member 32 from the surface of the concave portion 74 are virtually eliminated by bosses 74 and 76. As shown in FIG. 7, the bosses 74 urge the longitudinal axis 78 of the support members 32 and 34 in the direction of the arrows 80, whereas the bosses 76 urge the longitudinal axis 78 of the support members 32 and 34 in substantially the opposite direction, as indicated by the arrow 82. Thus, the bosses 74 and 76 provide a "snap-fit" of the support members 32 and 34 into the channels 28. Once the support members 32 and 34 are snapped into the channels 28, they may be attached to the table top section 12 as by inserting bolts or screws through the members 32 and 34 and into adjacent parts of the table top section 12.

Figure 8:
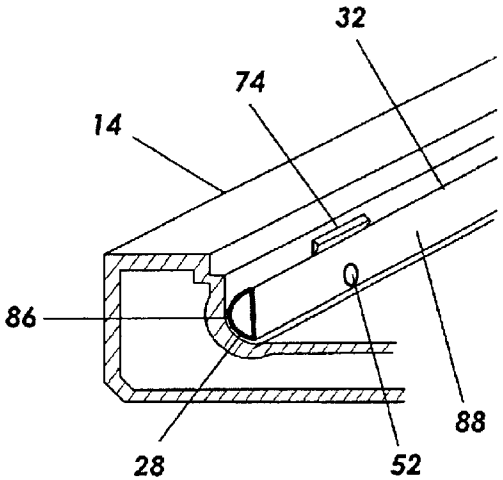
FIG. 8 is a cross-section perspective view of a portion of a collapsible table illustrating features of an alternative embodiment of the invention.

An alternative embodiment of the tubular support members 32 and 34 is depicted in FIG. 8. As shown in FIG. 8, the tubular support members 32 and 34 may have a substantially D-shaped cross-section, i.e., a half-cylindrical section 86 and a flat section 88. The D-shaped support members 32 and 34 have the advantage of providing a flat surface for receiving the ends of the cross members 36 and 38 and of reducing the lateral space occupied by the tubular support members 32 and 34, thereby providing more available lateral space to receive the leg assemblies 24 and 26 when they are folded down into the storage position, as shown in FIG. 2. They also resist downward bending forces by reason of flat sections 88 disposed generally parallel to such forces.

As a polymeric material is blow molded, stretched, and otherwise worked to form a table top, the corners of the table top may be or become thinner than central sections of the top. This can cause conventional hollow core or blow-molded table tops to tend to sag in the corners when a load is applied. Thus, a load applied in the corners of conventional tables is often not adequately supported. As described below, the table of the present invention overcomes this and other problems by providing a molded structure in each of the corners of the table top 12 to support the top surface 12*a*, even though the thickness of the material of the table top section 12 may be thinner adjacent the corners.

Figure 9:
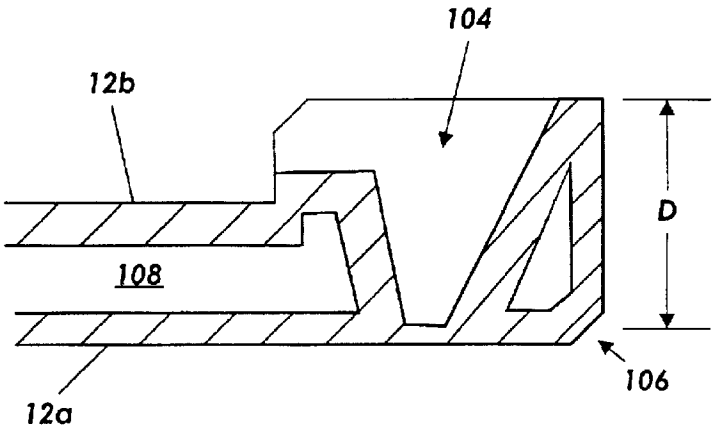
FIG. 9 is a cross-sectional view of a corner portion of a table illustrating features of a preferred embodiment of the invention.
Figure 10:
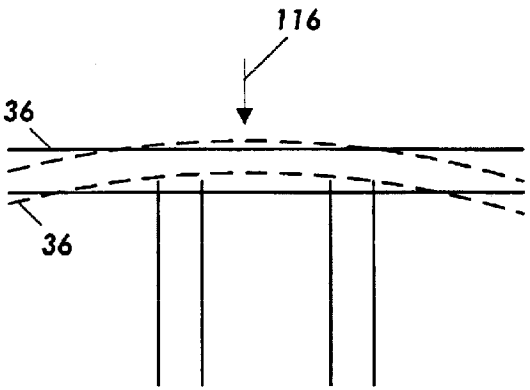
FIG. 10 is an elevation view of a portion of a cross-member and leg assembly illustrating features of a preferred embodiment of the invention.

As depicted in FIGS. 2, 3, and 9, an inverted frustoconical indentation 104 is provided adjacent each corner 106 of the bottom surface 12*b* of the table top section 12. The frustoconical indentation 104 is preferably generally kidney shaped. As shown in FIG. 10, an important feature of the indentation 104 is that there is preferably an absence of hollow space adjacent the indentation 104, as there is in remaining portions of the table top section 12. The shape of the indentation 104 and the depth D thereof provide a truss-like support for the top surface 12*a* adjacent the corners 106 of the table top 12.

Yet another important feature of the invention is depicted in FIGS. 3, 4, and 10. The bottom surface 12*b* of the table top section 12 preferably includes cradles 110 molded therein. The cradles 110 each preferably include first and second sections 112 and 114 disposed adjacent and to either side of a channel section 116. As shown in FIG. 3, the sections 112 and 114 of the cradles 110 are preferably disposed on opposing sides of cross members 34 and 36 so that the cross members 34 and 36 are received within the channel sections 116. In the preferred embodiment, the inside radius of the channel section 116 is equivalent or slightly larger than the outer radius of the central portions of the cross members 34 and 36, thereby allowing free rotation of the cross members 34 and 36 within the channels 116 as the leg assemblies 24 and 26 are rotated between folded and extended positions. While the cradles 110 are preferably formed integrally with the bottom surface 12*b* as by blow-molding, it will be recognized that the benefits and advantages of the cradles 110 may also be provided by structure formed separately from and attached to the bottom surface 12*b* of the table top 12.

In the preferred embodiment, the cradles 110 provide support for the cross members 34 and 36 when a load is placed toward an edge of the top surface 12*a* of the table top 12. As illustrated in FIG. 10, without the cradles 110, when a heavy load is placed on the top surface 12*a*, particularly adjacent the edges, the cross members 34 and 36 tend to bow as shown by dotted lines in FIG. 10. The cradles 110 are configured to provide an opposing downward force as indicated by arrow 116 adjacent the center of the cross members 34 and 36. Hence, the cross members 34 and 36 are urged to remain substantially straight, as shown by the solid lines in FIG. 10.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A collapsible table comprising:

an elongate table top having:

a substantially planar top surface;

a bottom surface opposite the top surface, the bottom surface having:

opposing elongate first and second side edges;

opposing end edges disposed substantially perpendicular to the first and second side edges;

an elongate first channel which is substantially parallel to the elongate first side edge;

an elongate second channel which is substantially parallel to the elongate second side edge; and first and second projections disposed on opposing sides of each of the elongate first and second channels;

a support frame attached to the bottom surface of the table top, the support frame including:

a first elongate tubular support member disposed in the elongate first channel;

a second elongate tubular support member disposed in the elongate second channel; and first and second pivotal leg assemblies, each having:

a tubular cross member pivotally attached to and spanning a space between the first and second elongate tubular support members; and one or more leg sections attached to the tubular cross member; and the first and second projections projecting outward from the bottom surface of the table top adjacent the elongate first and second channels, the first and second projections providing a snap fit engagement for retaining the first and second elongate tubular support members within the elongate first and second channels.

2. The table of claim 1 wherein each tubular cross member has a distal portion adjacent each end thereof and a central portion between each distal portion, the distal portion having a distal outer diameter and the central portion having a central outer diameter which is greater than the distal outer diameter.

3. The table of claim 2 wherein the first and second elongate tubular support members include apertures adjacent opposing ends thereof, the apertures having an inner diameter greater than the distal outer diameter of the tubular cross members, each of the apertures for receiving one of the distal portions of one of the tubular cross members.

4. The table of claim 3 further comprising a plurality of collars, each of the collars disposed on one of the distal portions of the tubular cross members and adjacent a corresponding one of the apertures in the first and second support members.

5. The table of claim 4 wherein the collars have an inside diameter greater than the distal outer diameter and less than the central outer diameter of the tubular cross members, and wherein each distal portion of the tubular cross members is received within one of the collars, the collars for maintaining the tubular cross members in a substantially laterally fixed relationship with respect to the first and second elongate tubular support members.

6. The table of claim 1 wherein the first and second projections are staggered with respect to each other on opposing sides of the first and second channels.

7. The table of claim 1 further comprising an indentation adjacent each corner of the bottom surface of the table top, each indentation providing support for the top surface of the table top in each corner thereof.

8. The table of claim 1 wherein the first and second elongate tubular support members comprise substantially cylindrical tubular members.

9. The table of claim 1 wherein the first and second elongate tubular support members comprise substantially D-shaped tubular members.

10. The table of claim 1 further comprising a cradle disposed between the elongate first and second channels in the bottom surface of the table top, the cradle for supporting one of the tubular cross members to reduce deflection of the cross member when a load is disposed on the table top.

11. A lightweight collapsible table comprising:

a table top having a top surface, a bottom surface, elongate side edges, and substantially parallel first and second elongate channels disposed in the bottom surface adjacent the elongate side edges;

a support frame attached to the bottom surface, the support frame including:

first and second elongate tubular members; and pivotal leg assemblies attached between the first and second elongate tubular members;

the bottom surface of the table top having first and second projections at least partially overhanging the first and second elongate channels on opposing sides of each of the first and second elongate channels, the first and second projections for providing a snap fit of the first and second elongate tubular members into the first and second elongate channels.

12. The table of claim 11 wherein each of the pivotal leg assemblies include leg sections and a tubular cross member attached to the leg sections, each tubular cross member pivotally disposed between the first and second elongate tubular members.

13. The table of claim 12 further comprising a cradle in the bottom surface of the table top substantially centrally disposed between the elongate tubular members, the cradle for urging a central portion of the tubular cross member away from the bottom surface of the table top when a load is disposed on the table top.

14. The table of claim 12 further comprising:

each tubular cross member having a distal portion adjacent each end thereof and a central portion between each distal portion, the distal portion having a distal outer diameter and the central portion having a central outer diameter which is greater than the distal outer diameter; and the first and second elongate tubular members having apertures therein adjacent opposing ends thereof, each of the apertures having an inner diameter sufficient to receive and allow rotation of one of the distal portions of the first or second elongate tubular members therein, thereby enabling pivotal rotation of the leg assemblies with respect to the first and second elongate tubular members.

15. The table of claim 14, further comprising:

collars having an inside diameter greater than the distal outer diameter of the distal portions of the tubular cross members and less than the central outer diameter of the central portion of the tubular cross members; and each of the distal portions of the tubular cross members received within one of the collars.

16. The table of claim 11 further comprising an indentation adjacent each corner of the bottom surface of the table top to provide support for the top surface of the table top.

17. The table of claim 11 wherein the first and second projections are staggered with respect to each other on opposing sides of the first and second elongate channels.

18. A collapsible table comprising:

an elongate table top having:

a substantially planar top surface;

a bottom surface opposite the top surface, the bottom surface having:

opposing elongate first and second side edges;

opposing end edges disposed substantially perpendicular to the first and second side edges;

an elongate first cylindrical channel formed as an integral portion of the bottom surface of the table top, the first cylindrical channel adjacent and substantially parallel to the elongate first side edge, the elongate first cylindrical channel having a first inside radius; and an elongate second cylindrical channel formed as an integral portion of the bottom surface of the table top, the second cylindrical channel adjacent and substantially parallel to the elongate second side edge, the elongate second cylindrical channel having a second inside radius; and a support frame attached to the bottom surface of the table top, the support frame including:

a first elongate cylindrical support member received within the elongate first cylindrical channel and secured to the elongate first cylindrical channel at a plurality of attachment points, the first elongate cylindrical support member having a first outside radius equivalent to or slightly smaller than the first inside radius of the elongate first cylindrical channel;

a second elongate cylindrical support member received within the elongate second cylindrical channel and secured to the elongate second cylindrical channel at a plurality of attachment points, the second elongate cylindrical support member having a second outside radius equivalent to or slightly smaller than the second inside radius of the elongate second cylindrical channel; and first and second pivotal leg assemblies, each having:

a cross member pivotally attached to and spanning a space between the first and second elongate cylindrical support members; and one or more leg sections attached to the cross member.

19. A collapsible table comprising:

an elongate table top having:

a substantially planar top surface;

a bottom surface opposite the top surface, the bottom surface having:

opposing elongate first and second side edges;

opposing end edges disposed substantially perpendicular to the first and second side edges;

an elongate first cylindrical channel adjacent and substantially parallel to the elongate first side edge, the elongate first cylindrical channel having a first inside radius; and an elongate second cylindrical channel which is substantially parallel to the elongate second side edge, the elongate second cylindrical channel having a second inside radius; and a support frame attached to the bottom surface of the table top, the support frame including:

a first elongate cylindrical support member received within the elongate first cylindrical channel, the first elongate cylindrical support member having a first outside radius equivalent to or slightly smaller than the first inside radius of the elongate first cylindrical channel;

a second elongate cylindrical support member received within the elongate second cylindrical channel, the second elongate cylindrical support member having a second outside radius equivalent to or slightly smaller than the second inside radius of the elongate second cylindrical channel; and first and second pivotal leg assemblies, each having:

a cross member pivotally attached to and spanning a space between the first and second elongate cylindrical support members; and one or more leg sections attached to the cross member, wherein the bottom surface of the elongate table top further comprises first and second projections at least partially overhanging the elongate first and second cylindrical channels on opposing sides of each of the elongate first and second cylindrical channels, the first and second projections for providing a snap fit of the first and second elongate cylindrical support members into the elongate first and second cylindrical channels.

20. The table of claim 19 wherein the first and second projections are staggered with respect to each other on opposing sides of the elongate first and second cylindrical channels.

21. A collapsible table comprising:

an elongate table top having:

a substantially planar top surface;

a bottom surface opposite the top surface, the bottom surface having:

opposing elongate first and second side edges;

an elongate first cylindrical channel formed as an integral portion of the bottom surface of the table top, the first cylindrical channel adjacent and substantially parallel to the elongate first side edge; and an elongate second cylindrical channel formed as an integral portion of the bottom surface of the table top, the second cylindrical channel adjacent and substantially parallel to the elongate second side edge; and a first elongate cylindrical frame member received within the elongate first cylindrical channel substantially parallel to the elongate first side edge of the bottom surface of the table top;

a second elongate cylindrical frame member received within the elongate second cylindrical channel substantially parallel to the elongate second side edge of the bottom surface of the table top; and first and second pivotal leg assemblies, each having:

a cross member pivotally attached to and spanning a space between the first and second elongate cylindrical frame members; and one or more leg sections attached to the cross member.

22. The collapsible table of claim 21 wherein the bottom surface of the elongate table top further comprises first and second projections at least partially overhanging the elongate first and second cylindrical channels, the first and second projections for providing a snap fit of the first and second elongate cylindrical frame members into the elongate first and second cylindrical channels.

* * * * *